US006955611B2

(12) United States Patent
Kimmel

(10) Patent No.: US 6,955,611 B2
(45) Date of Patent: Oct. 18, 2005

(54) METHOD AND APPARATUS FOR PLAYING A GAME OF GOLF

(76) Inventor: Bradley D. Kimmel, 13840 Brownwood La., Evansville, IN (US) 47724

( * ) Notice: Subject to any disclaimer, the term of this patent is extended or adjusted under 35 U.S.C. 154(b) by 0 days.

(21) Appl. No.: 10/784,006

(22) Filed: Feb. 20, 2004

(65) Prior Publication Data

US 2005/0187029 A1 Aug. 25, 2005

(51) Int. Cl.[7] ..... A63B 57/00
(52) U.S. Cl. ..... 473/287; 473/409; 273/144 R
(58) Field of Search ..... 473/409, 282, 473/287; 273/144 A, 144 B, 148 R, 309, 273/144 R, 245, 138.1, 139, 141 R, 141 A, 273/146, 142 R, 142 A, 142 B, 142 C, 142 E, 273/142 F, 142 G

(56) References Cited

U.S. PATENT DOCUMENTS

| | | | | |
|---|---|---|---|---|
| 3,863,929 | A * | 2/1975 | Kahan | 273/275 |
| 4,019,748 | A | 4/1977 | Healey | |
| 4,809,985 | A | 3/1989 | Trimble | |
| 4,988,105 | A | 1/1991 | Perry et al. | |
| 5,000,460 | A | 3/1991 | Barbiaux et al. | |
| 5,234,218 | A | 8/1993 | LaRocca | |
| 5,490,671 | A | 2/1996 | Picard | |
| 5,505,452 | A | 4/1996 | Meaden | |
| 5,720,482 | A | 2/1998 | Boudrias | |
| 5,924,693 | A | 7/1999 | Beaumier et al. | |
| 6,036,606 | A | 3/2000 | Dumas | |
| 6,047,967 | A | 4/2000 | Murphy et al. | |
| 6,209,870 | B1 | 4/2001 | Shea et al. | |
| 6,224,486 | B1 | 5/2001 | Walker et al. | |
| 6,425,828 | B2 | 7/2002 | Walker et al. | |
| 6,457,713 | B1 | 10/2002 | Oppenheimer et al. | |
| 6,568,681 | B1 | 5/2003 | Meyer | |
| 2002/0004723 | A1 | 1/2002 | Meifu et al. | |
| 2002/0046137 | A1 | 4/2002 | Odom et al. | |
| 2002/0105140 | A1 | 8/2002 | Field | |
| 2003/0006552 | A1 | 1/2003 | Barry | |
| 2003/0011128 | A1 | 1/2003 | Brill | |
| 2003/0025269 | A1 | 2/2003 | Stranger | |
| 2003/0160387 | A1 | 8/2003 | Drury | |

* cited by examiner

*Primary Examiner*—Stephen Blau
(74) *Attorney, Agent, or Firm*—Woodard, Emhardt, Moriarty, McNett & Henry LLP

(57) ABSTRACT

An apparatus for playing a game of golf for at least two players, each player having a set of golf clubs including a plurality of irons, a plurality of woods and a putter, includes a game set of indicators that includes a club set of indicators bearing club identifications, a reserve set of indicators bearing reserve indications, a shot set of indicators bearing shot indications and a flag set of indicators bearing flag indications; and, a container for holding the game set of indicators and permitting a player to randomly and blindly draw one of the indicators.

38 Claims, 3 Drawing Sheets

METHOD AND APPARATUS FOR PLAYING A GAME OF GOLF

FIELD OF THE INVENTION

The present invention relates to the field of games, and more specifically, to a method and apparatus for playing a game of golf.

BACKGROUND OF THE INVENTION

The principle game of golf is well known, and its rules are codified in the USGA Rules of Golf. In part, they provide for playing a course of 18 holes, each hole beginning with a tee shot and ending when the ball goes into the cup. Each player may carry and use a maximum of 14 clubs chosen from a group comprising irons (typically 1–9 and one or more sand wedges), drivers (typically 1–5) and a putter. In match play, the person with the lowest number of strokes through the 18 hole course is the winner.

Variations in the format for playing golf, such as the Florida scramble and the skins game, are widely popular and have broadened the game's appeal, for both players and spectators.

SUMMARY OF THE INVENTION

Generally speaking, an apparatus and method are provided for playing a game of golf that includes wagering and periodic elimination of players until just one player remains as the winner. The apparatus may include a set of golf clubs, or each player may be presumed to have his own set of golf clubs, such set of clubs including a plurality of irons, a plurality of woods and a putter. The apparatus further includes a game set of indicators that includes a club set of indicators bearing club identifications, a reserve set of indicators bearing reserve indications, a shot set of indicators bearing shot indications and a flag set of indicators bearing flag indications. The apparatus further includes a container for holding the game set of indicators and permitting a player to randomly and blindly draw one of the indicators. Before teeing off at each hole, each player draws two indicators and, in addition, two "common" indicators are drawn. The indicia appearing on the indicators dictates which club(s) each player may use. The indicators also bear certain advantages that may assist a player in being the first to sink his ball in the cup and win the hole. Wagering occurs at various stages before and during play on each hole. Each player begins the round with an amount of points, and players are eliminated throughout the round as they bet, lose and eventually run out of points until just one player remains, who is the winner.

It is an object of the present invention to provide an alternative and improved method and apparatus for playing golf.

Other objects and advantages of the present invention will become apparent from the following description of the preferred embodiment.

DESCRIPTION OF THE PREFERRED EMBODIMENT

Figure 1:
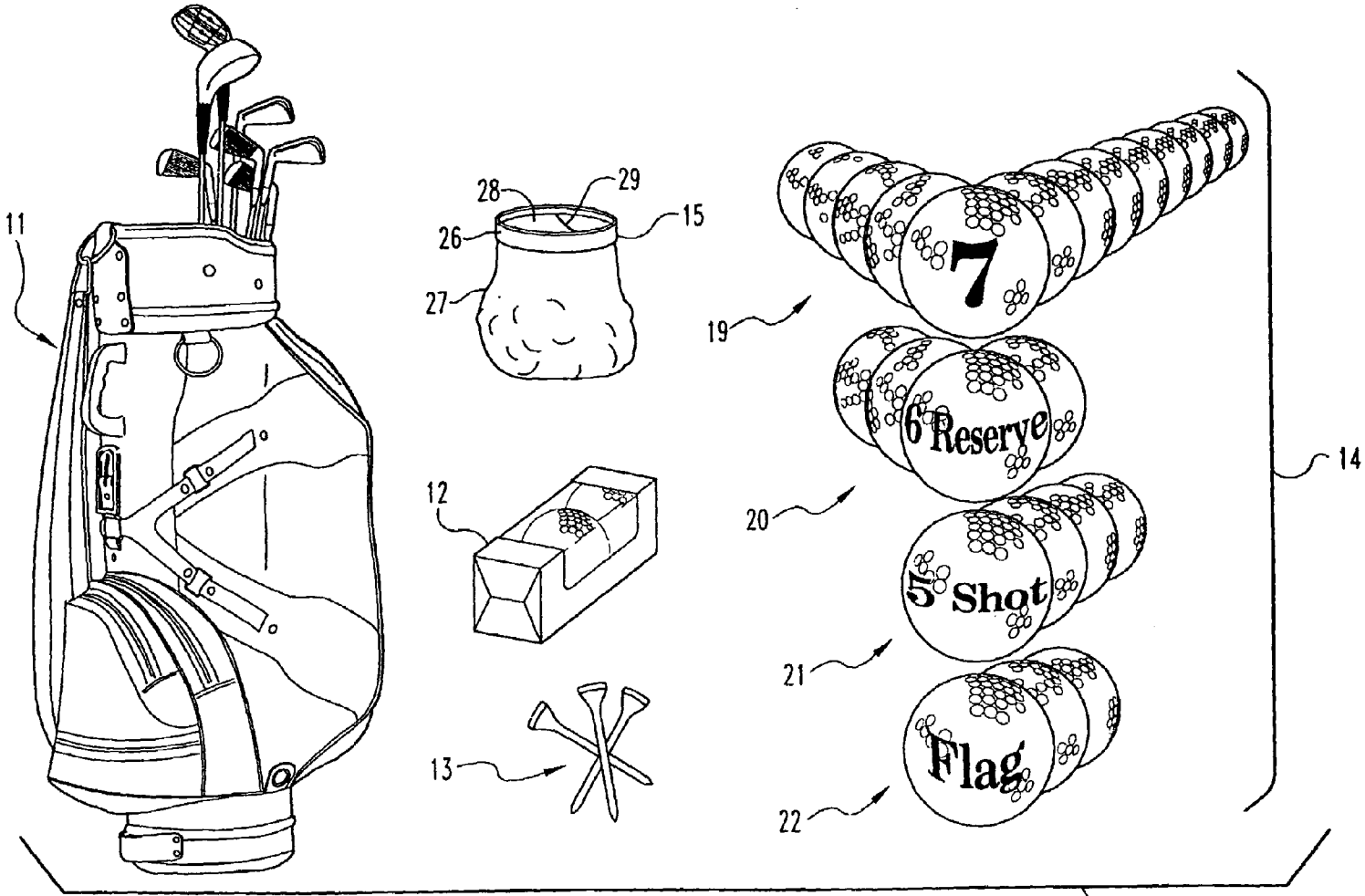
FIG. 1 is a diagrammatic view of an apparatus for playing golf in accordance with one view of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, and any alterations or modifications in the illustrated device, and any further applications of the principles of the invention as illustrated therein are contemplated as would normally occur to one skilled in the art to which the invention relates.

Referring now to FIG. 1, there is shown an apparatus 10 for playing a game of golf in accordance with one embodiment of the present invention. Apparatus 10 generally includes a set of golf clubs 11, golf balls 12, tees 13, a game set of indicators 14 and an indicator container 15. In the present embodiment, the golf clubs 11, balls 12 and tees 13 are standard elements in accordance with USGA rules, are well known and are generally supplied by the game participant. Tees may or may not be used, as desired. It is contemplated that each player will have his own set of clubs, balls and tees; however sharing, though not preferred, may be permitted. As used herein, the set of golf clubs 11 is intended to include a set of irons (3–9, wedge and sand wedge), a set of woods (driver, 3-wood and 5-wood) and a putter. Alternative embodiments contemplate incorporating other irons (e.g. 1-iron, 2-iron, etc.) and/or other woods (e.g. 2-wood, 7-wood, etc.) as desired. Variations in the size, configuration and construction of the clubs, balls and tees do not form a part of the present embodiment, but are contemplated by alternative embodiments. For example and without limitation, alternative embodiments include permitting or providing clubs having oversized heads, which would not otherwise be allowed by USGA Rules. Alternative embodiments also contemplate permitting or providing other golfing equipment and accessories that would not otherwise be allowed, such as and without limitation, permitting or providing golf carts, shot aiming devices, etc.

Game set of indicators 14 includes a club set of 13 indicators 19, a reserve set of four indicators 20, a shot set of four indicators 21, and a flag set of three indicators 22, all 24 of which in the present embodiment are golf balls with indicia appearing on them. Hereinafter, indicators 14 may also be referred to as indicator balls 14 or balls 14, and club indicators 19 may hereinafter be referred to as club balls 19; reserve indicators 20 as indicator balls 20; shot indicators 21 as shot balls 21; and, flag indictors 22 as flag balls 22. Other embodiments are contemplated in which indicators 14 are other than golf balls, such as and without limitation: balls that are not golf balls, but that look and/or feel like golf balls; poker chips; ping pong balls; cubes; or, any other item on which in some way bears indication of the club, reserve, shot or flag element that is to be drawn, as described herein. Indicator container 15 includes a ring frame 26, a bag 27 suspended from frame 26, and a cover 28 closing off the opening to the bag 27 through frame 26. Cover 28 has a slit 29 through which a person can access the inside of bag 27 through frame 26. Container 15 may be of any suitable form that holds the one or more indicators 14 and enables someone to randomly and blindly select one of the indicators 14 held in bag 27. In other embodiments, container 15 is contemplated to comprise a box, a hat, a bowl, an electronic device, such as a computer or any appropriate device that permits a player or other person to randomly and blindly select one or more from a group of indicators. In the latter case, for example and without limitation, indicators 14 would not comprise physical elements, but would be incorporated in a program on an electronic device such as a computer, and the player would make an electronic entry that causes the computer to produce a random result that indicates that player's drawn indicator.

Figure 2:
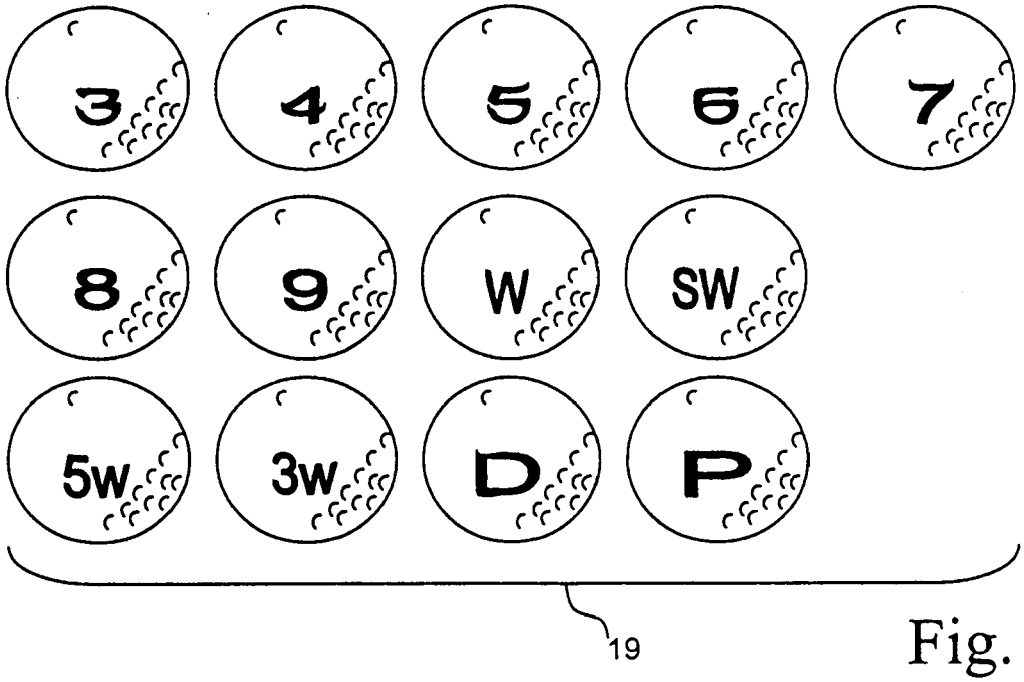
FIG. 2 is a diagrammatic view of the club set of indicators 19 of the apparatus 10 of FIG. 1.
Figure 3:
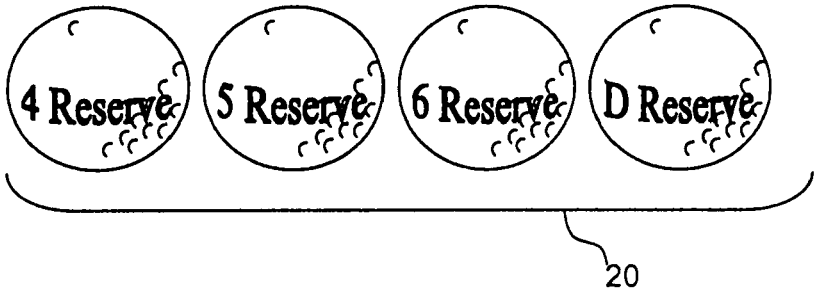
FIG. 3 is a diagrammatic view of the reserve set of indicators 20 of the apparatus 10 of FIG. 1.
Figure 4:
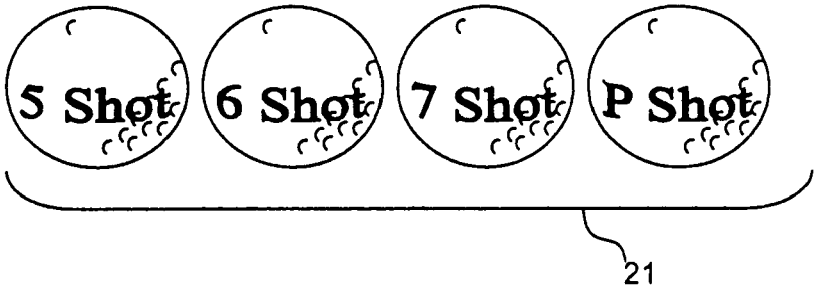
FIG. 4 is a diagrammatic view of the shot set of indicators 21 of the apparatus 10 of FIG. 1.
Figure 5:
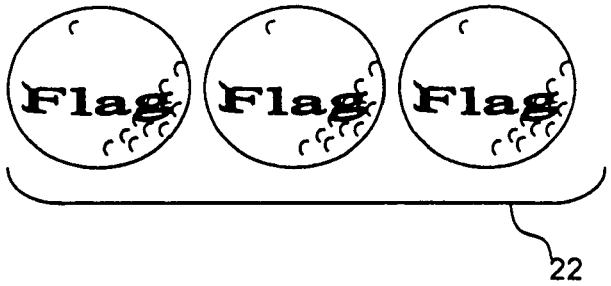
FIG. 5 is a diagrammatic view of the flag set of indicators 22 of the apparatus 10 of FIG. 1.

Referring to FIG. 2, club set of indicators 19 includes 13 balls on each of which is imprinted one of the following club indications: 3, 4, 5, 6, 7, 8, 9, W, SW, 5w, 3w, D, P, respectively, which stand for irons 3–9, wedge, sand wedge, 5-wood, 3-wood, driver and putter. If other irons or woods are to be used, the club balls 19 would include the appropriate corresponding representative indicia, as well. For example, for irons just a single number (e.g. 1 and 2 for a 1 iron and 2 iron) and for woods, the number and letter "w" (e.g. 2w and 7w for a 2 wood and 7 wood). Referring to FIG. 3, reserve set of indicators 20 includes 4 balls on each of which is imprinted one of the following reserve indications: 4 Reserve, 5 Reserve, 6 Reserve, D Reserve. The 4, 5, 6 and D appearing before the word "Reserve" stands for 4 iron, 5 iron, 6 iron and driver, respectively. Referring to FIG. 4, shot set of indicators 21 includes 4 balls on each of which is imprinted one of the following shot indications: 5 Shot, 6 Shot, 7 Shot, P Shot. The 5, 6, 7, and P appearing before the word "Shot" stands for 5 iron, 6 iron, 7 iron and putter, respectively. Referring to FIG. 5, flag set of indicators 22 includes 3 balls on each of which is imprinted one of the following flag indications: Flag, Flag, Flag.

Using the aforedescribed apparatus, a method for playing a game of golf is as follows:

Object of the Game. The object of the game is for each player to acquire the most points by winning individual golf holes. Points are wagered by players during play, with the winner of each hole taking all the points wagered on that hole. During play players are eliminated, until a winner is determined. Thus, a winner may be determined without playing all 18 holes of a standard golf course.

Rules of Play. To the extent not inconsistent with the following rules of play, the USGA Rules of Golf are adopted as part of the invention, and are hereby incorporated by reference. The game may be played by a group consisting of any two or more players, but preferably not more than four players in any one group. Each player begins play with 100,000 points and a set of golf clubs, balls and tees. On the first tee, an initial playing order is decided by any appropriate means such as one or more rolls of dice, drawing straws, etc. For example and without limitation, each player rolls the dice until only one of the group of players rolls the highest number. The remaining players of the group then roll until only one of them rolls the highest number, and so on. Play begins as each player antes up 5,000 points and a "pool" is established for that hole. Wagering may be accomplished throughout the contest verbally and recorded by a game steward on a tote board, computer or other device (not shown) suitable for accurate record keeping and display by the participants and spectators. In an alternative embodiment, each player may be given poker chips in suitable denominations totaling 100,000 points. Each player may then ante up and wager, as in poker, directly into a "pool" that is administered by a game steward.

Next, with bag 27 containing all 24 of the indicator balls 14, each player, using the initial playing order, draws two (a first and a second) balls 14 from bag 27. Each player is to see only the balls he draws. No player is to see the balls drawn by other players in the group. Except for flag balls 22, each of balls 14 has a club designation on it and indicates which club(s) the player is permitted to use on the current hole. As used herein, "current hole" is intended to include and refer to all shots, drawing of balls, wagering and other related game activity for a golf hole (Hole 1, for example) from just before the first player tees off until a player first puts his ball 12 in the cup of such hole. Thereafter, the next hole (Hole 2) becomes the current hole, and so on. After each player has drawn his two player balls 14, the game steward draws two balls 14 from bag 27, which become "common" balls. The club designations on the common club balls, as the name suggests, can be used by any of the players. At this point, each player now has up to four club balls to use, two of his own, and two that are shared by all players. It should be noted that a player could draw two of the flag balls 22, and the game steward could draw a flag ball and the P club ball 19, in which case such player would have only his putter with which to tee off.

Next, the first round of wagering begins. Using the initial order of play, each player has a chance to "check" or "raise" before the first tee shot. Should a player raise, other players must meet the raise to stay in the game. Next, the players tee off, based again on the initial order of play. Each player may only use one of the clubs available to him as indicated on the common balls and the balls that he has drawn. Thus, where the game steward drew a flag ball 22 and a "P Shot" shot ball 21 and a player drew a "7" club ball 19 and a "6 Shot" shot ball 21, such player must tee off with one of his 6 iron, 7 iron or putter. Once all players have hit, play moves to the next shot location (which is the golf ball farthest from the pin 36 (FIG. 6), and another common ball is drawn by the game steward and added to the common balls that each player may use. Then another round of wagering takes place. After that, each player takes his next shot, again using one of the clubs available to him as indicated on the now three common balls and two balls he has drawn. From the previous example, if the game steward has just drawn the "5W" club ball 19, then the example player may hit his second shot using one of his 6 iron, 7 iron, putter or 5 wood. Play and common ball drawings continue before each set of shots in this manner until a player first puts his ball in the standard cup 40 of that hole's green 41 (FIG. 6), upon which such player wins the hole. The winner of each hole takes the entire wagered pool for that hole. Play moves to the next hole and the same process is repeated. As play continues, players are eliminated as they wager, lose and run out of points until only one player remains, who becomes the champion.

Figure 6:
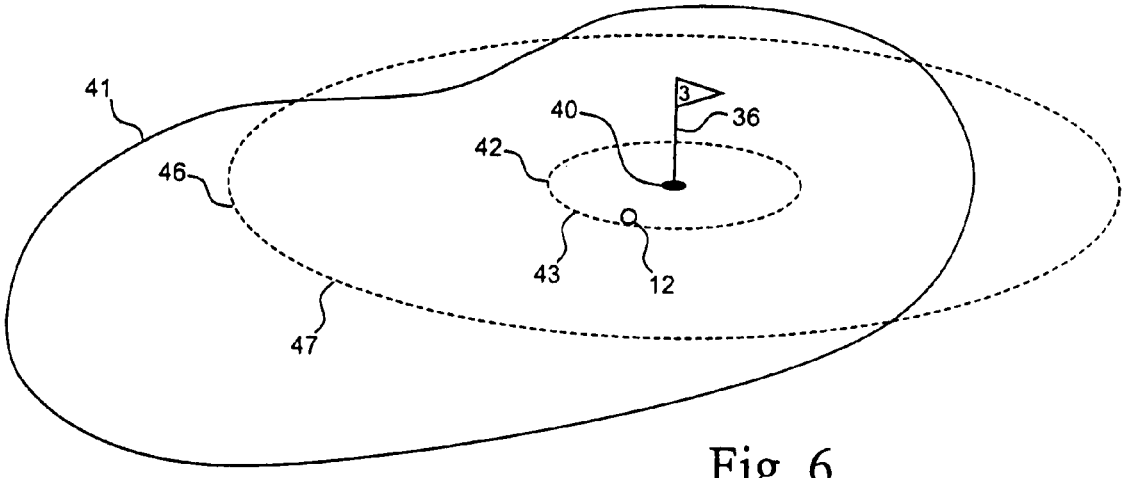
FIG. 6 is a perspective view of a golf course putting green 41 showing application of the flag balls 22.

Player Advantage Combinations: There are several combinations of balls that can give a player an advantage over his opponents:

Referring to FIG. 6, any two flag balls 22, in essence, enlarges the standard cup 40 to four feet in diameter, thus creating for that player an enlarged cup 42. Thus, a player holding two flags balls 22 (from the combination of his own drawn balls and the common balls) is scored as in the cup once his golf ball 12 comes to rest within the four foot diameter enlarged cup 42. If such player's ball 12 touches any part of the circle 43 marking the enlarged cup 42, such ball 12 is deemed in the cup. Only a player holding two flag balls 22 may benefit by use of the enlarged cup 42; other players not holding at least two flag balls 22 must put their ball in the standard cup 40 to win the hole.

Any three flags balls 22, in essence, enlarges the standard cup 40 to 14 feet in diameter, thus creating for that player a super cup 46. So a player holding all the three flag balls 22 (from the combination of his own drawn balls and the common balls) is scored as in the cup once his golf ball 12 comes to rest within the 14 foot diameter super cup 46. If such player's ball 12 touches any part of the circle 47 marking the super cup 46, such ball 12 is deemed in the cup. Only a player holding all three flag balls 22 may benefit by use of the super cup 46; other players not holding all three flag balls 22 must put their balls in the standard cup 40 or an enlarged cup 42 to win the hole.

Any reserve ball 20, matched with a shot ball 21, gives that player a Reserve Shot and allows him to repeat a shot of his choice once during the current hole. The reserve ball 20 and shot ball 21 are played in pairs, but it is possible for a player to earn more than one Reserve Shot during the current hole by having more than one pair (reserve ball 20 and shot ball 21) during play on the current hole. The election to repeat a shot must be made and performed immediately after the shot to be repeated.

Before the first tee shot on the current hole, player holding any two matching clubs designations is permitted to tee of from any of the available tee boxes of that hole. This is the only situation when matching clubs have any meaning during the game. For example, if the game steward draws a "4 Reserve" reserve ball 20 and a "P Shot" shot ball 21 and a player draws a "P" club ball 19 and a "D" club ball 19, such player has two "P" club designations and may tee off from any of the tee boxes, for example, the ladies tee box. In this example, such player may tee off with his 4 iron, his putter or his driver.

Note: If any of the foregoing combinations (i.e. flag ball 22 and flag ball 22, or "P Shot" shot ball 21 and "P" club ball 19) appear in the common club balls during the current hole, all players share that advantage during the current hole.

Winning the Hole. The first player to put his ball 12 in the standard cup 40, enlarged cup 41 or super cup 46 wins the current hole and the pool, and play for current hole is over. The other players do not get a chance to tie if they have not yet had their turn.

Order of Wagering and Play. The order of play dictates which player acts first, second, third and so on when it comes to wagering and hitting the ball. However, there are two rules that determine the order of play:

First, before play begins at the first hole, rolling the dice (as described above) is used to determine the "initial order of play" on the first tee. Thereafter, the order of play rotates one position at each subsequent tee box. For example, players Tom, Beth, Jim and Brad roll the dice and produce a playing order of: $1^{st}$ Brad, $2^{nd}$ Jim, $3^{rd}$ Beth, and $4^{th}$ Tom. Brad tees off first, Jim second, and so on. On the second hole, Jim tees off first, Beth second, and so on. On the third hole, Beth tees off first, Tom second and so on.

The second rule determining the order of play is that once the tee shots are complete on the current hole, the order of play for each successive set of shots on the current hole (referred to as the "lag order") is determined by whose ball 12 is farthest from the pin 36 or "away." Thus, after all players in the group tee off (assuming no one has holed his ball), if Tom's ball is the farthest from the pin 36, then Brad's, then Beth's, then Jim's, then the lag order of play for each persons second shot is $1^{st}$ Tom, $2^{nd}$ Brad, $3^{rd}$ Beth, and $4^{th}$ Jim. After the second shots are complete, the lag order for the third set of shots (and fourth, and fifth, etc.) is again determined by the order of the distance of the balls from the pin 36.

Wagering. In one embodiment, wagering is as follows:

Each player begins play with 100,000 points. On each hole, each player must put an ante into the pot for that hole. In one embodiment, the antes are as follows:

During the first three holes: 5,000 points
During the next three holes: 10,000 points
All holes after that: 20,000 points If a player does not have enough points for the next hole's ante, then that player is eliminated from competition. The minimum bet is 5,000 points. The maximum bet is as follows:

During the first three holes: 20,000
During the next three holes: 50,000
All holes after that: No Limit If a player declares that he is "all in", meaning he is wagering all of his remaining points, then the remaining players must match such player's "all in" wager, further wagering stops at that point and play continues to see who wins that hole.

General Rules. If a player's ball 12 lands out of bounds or is deemed unplayable in a water hazard, then that player automatically "folds" and he loses any points wagered to that point on that hole.

The ball must be played "down" and may not be touched by a player, a player's club or other object, or by a caddie. If a player touches a ball, he automatically "folds" on that hole. If the game steward deems the touch "intentional", so as to gain an advantage over fellow players, then that player is disqualified from the entire competition without recourse. A player may ask the game steward for permission to lift and clean a ball with mud clearly visible on it. However, the game steward may decline the request.

The players may only use the clubs indicated on the club balls 19, reserve balls 20 or shot balls 21, either in their possession or on the common balls. If a player uses a club not available to him on the current hole, then he automatically "folds" and loses any points wagered to that point on the current hole. If the game steward deems the use of an unavailable club as "intentional", so as to gain an advantage over fellow players, then that player is disqualified from the entire competition without recourse.

All players are responsible of keeping track of the rules, their own indicator balls, the common balls, and any and all other information available to them during the course of play. If a player is misinformed, the hole(s) played while the player was misinformed, will not be replayed and that player will not be given back any points wagered, based on such misinformation.

All decisions of the game steward are final. There is no appeal process.

The present invention contemplates a entry fees by the participants and prize money to be paid out finishing in the top one or more positions, depending on the order in which the players were eliminated. Other prize payout configurations are also contemplated as are known in various gaming events.

The game for playing golf described herein is contemplated to be played on any standard golf course. Alternative embodiments are contemplated wherein the game for playing golf described herein can be played on a non-standard golf course, indoors or outdoors. Alternative embodiments are contemplated wherein the game for playing golf described herein could be played as a board or video game, with all elements (such as golf clubs 11, balls 12, tees 13, indicator 14 and container 15) modified and included as necessary and/or desirable to accommodate the particular medium in which the game is intended to be played. Alternative embodiments are also contemplated wherein the game for playing golf described herein could be played by one or more people over the internet. Such embodiment would include a host site into which one or more players could log in and play. Appropriate software may be downloaded and loaded onto the players computer to facilitate faster and/or more fully featured play.

Use of the masculine and feminine genders herein may be interchanged without effect to the spirit and meaning of the invention.

The present invention contemplates replacing any of the club indications (i.e. 3, 4, W, 5w, etc.) and/or any of the terms "Reserve", "Shot" and "Flag" with any appropriate other term, icon, picture or device wherein such replacement is intended to carry the same meaning as the indication it replaced.

Description of the present invention employs commonly used golf terms. For example, a golf course has a plurality of "holes" (typically 18), each hole having a plurality of tee boxes, a fairway and a putting green, which has a cup.

The present invention contemplates play in a single tournament, as well as play in a succession of tournaments as part of a tour. It is also comtemplated that one or more of such tournments would be televised.

Alternative embodiments are contemplated wherein the club set of indicators may comprise more or fewer than 13 club indicators 19, wherein the reserve set of indicators may comprise more or fewer than four reserve indicators 20 (including just one reserve indicator 20), wherein the shot set of indicators may comprise more or fewer than four shot indicators 21 (including just one shot indicator 21), and wherein the flag set of indicators may contain more or fewer than three flag indicators 22 (including just one flag indicator 22, in which case only one flag indicator 22 would be necessary to enlarge the hole to some predetermined diameter).

Alternative embodiments are contemplated wherein the club set of indicators may comprise actual clubs. For example and without limitation, each of the clubs may be arranged in or behind a housing or enclosure with just a portion of the grip exposed. Each player would then draw his club directly, though still blindly and randomly, by chosing from the visible hand grips. The common clubs could be drawn in a similar manner. In this imbodiment, the container as described above, would comprise the housing, enclosure or other structure or artifice enabling a blind and random draw.

Alternative embodiments are contemplated wherein the indicator balls may include other benefits, bonuses, penalties or hazards for the players. For example and without limitation, an indicator ball 14 may carry the word "Sand" whereupon such player must drop his ball in the middle of the sand trap closest to his current ball position and between such position and the pin. In further example and without limitation, one or more indicator balls 14 could carry the words "5000 Points" (or any chosen point value) whereupon such player could at any time during play on any hole surrender such indicator and be given an extra 5000 points, but such accepting of additional points would be in place of taking his shot at that time. Thus a player who has drawn the 5000 point ball and believes himself to be a full shot ahead of the other players in his group, may trade in his 5000 point ball for the 5000 points, forfeit his shot and hope another player does not win the hole by sinking his ball on that round of shots.

While the invention has been illustrated and described in detail in the drawings and foregoing description, the same is to be considered as illustrated and not restrictive in character, it being understood that only the preferred embodiment and a few alternative embodiments have been shown and described and that all changes and modifications that come within the spirit of the invention are desired to be protected.

What is claimed is:

1. An apparatus for playing a game of golf for at least two players, comprising:

a set of golf clubs including a plurality of irons, a plurality of woods and a putter;

a game set of indicators that includes a club set of indicators bearing club identifications, a reserve set of indicators bearing reserve indications, a shot set of indicators bearing shot indications and a flag set of indicators bearing flag indications; and, container means for holding said game set of indicators and permitting a player to randomly and blindly draw one of said indicators.

2. The apparatus for playing a game of golf for at least two players of claim 1 wherein said club set of indicators includes 13 club indicators, each bearing only one of the following club identifications: 1, 2, 3, 4, 5, 6, 7, 8, 9, W, SW, 7w, 6w, 5w, 4w, 3w, 2w, D, P.

3. The apparatus for playing a game of golf for at least two players of claim 1 wherein said club set of indicators includes a plurality of club indicators, each bearing one of the following club identifications: 3, 4, 5, 6, 7, 8, 9, W, SW, 5w, 3w, D, P.

4. The apparatus for playing a game of golf for at least two players of claim 1 wherein said reserve set of indicators includes four reserve indicators, each bearing only one of the following reserve indications: 4 Reserve, 5 Reserve, 6 Reserve, D Reserve.

5. The apparatus for playing a game of golf for at least two players of claim 1 wherein said shot set of indicators includes four shot indicators, each including only one of the following shot indications: 5 Shot, 6 Shot, 7 Shot, P Shot.

6. The apparatus for playing a game of golf for at least two players of claim 1 wherein said flag set of indicators includes three flag indicators, each including only one of the following flag indications: Flag, Flag, Flag.

7. The apparatus for playing a game of golf for at least two players of claim 1 wherein said game set of indicators are golf balls.

8. The apparatus for playing a game of golf for at least two players of claim 1 wherein said game set of indicators includes at least 24 indicators, at least 13 of which bear only one of the following club identifications: 1, 2, 3, 4, 5, 6, 7, 8, 9, W, SW, 7w, 6w, 5w, 4w, 3w, 2w, D, P.

9. The apparatus for playing a game of golf for at least two players of claim 1 wherein said reserve set of indicators includes at least one reserve indicator, each reserve indicator bearing the term Reserve.

10. The apparatus for playing a game of golf for at least two players of claim 9 wherein each reserve indicator bears one of the following club identifications: 1, 2, 3, 4, 5, 6, 7, 8, 9, W, SW, 7w, 6w, 5w, 4w, 3w, 2w, D, P.

11. The apparatus for playing a game of golf for at least two players of claim 10 wherein there are four reserve indicators each bearing one of the following club identifications: 4, 5, 6 and D.

12. The apparatus for playing a game of golf for at least two players of claim 1 wherein said shot set of indicators includes at least one shot indicator, each shot indicator bearing the term Shot.

13. The apparatus for playing a game of golf for at least two players of claim 12 wherein each shot indicator bears one of the following club identifications: 1, 2, 3, 4, 5, 6, 7, 8, 9, W, SW, 7w, 6w, 5w, 4w, 3w, 2w, D, P.

14. The apparatus for playing a game of golf for at least two players of claim 13 wherein there are four shot indicators each bearing one of the following club identifications: 5, 6, 7 and P.

15. The apparatus for playing a game of golf for at least two players of claim 1 further including a point set of point indicators.

16. The apparatus for playing a game of golf for at least two players of claim 15 wherein said point indicators total 100,000 points for each player.

17. An apparatus for playing a game of golf for at least two players, each player having a set of golf clubs including a plurality of clubs from a group consisting of irons, woods and a putter, comprising:

a game set of indicators that includes a club set of indicators bearing club identifications, a reserve set of indicators bearing reserve indications, a shot set of indicators bearing shot indications and a flag set of indicators bearing flag indications; and, container means for holding said game set of indicators and permitting a player to randomly and blindly draw one of said indicators.

18. The apparatus for playing a game of golf for at least two players of claim 17 wherein said club set of indicators includes 13 club indicators, each bearing only one of the following club identifications: 1, 2, 3, 4, 5, 6, 7, 8, 9, W, SW, 7w, 6w, 5w, 4w, 3w, 2w, D, P.

19. The apparatus for playing a game of golf for at least two players of claim 17 wherein said club set of indicators includes a plurality of club indicators, each bearing one of the following club identifications: 3, 4, 5, 6, 7, 8, 9, W, SW, 5w, 3w, D, P.

20. The apparatus for playing a game of golf for at least two players of claim 17 wherein said reserve set of indicators includes four reserve indicators, each bearing only one of the following reserve indications: 4 Reserve, 5 Reserve, 6 Reserve, D Reserve.

21. The apparatus for playing a game of golf for at least two players of claim 17 wherein said shot set of indicators includes four shot indicators, each including only one of the following shot indications: 5 Shot, 6 Shot, 7 Shot, P Shot.

22. The apparatus for playing a game of golf for at least two players of claim 17 wherein said flag set of indicators includes three flag indicators, each including only one of the following flag indications: Flag, Flag, Flag.

23. The apparatus for playing a game of golf for at least two players of claim 17 wherein said game set of indicators are golf balls.

24. The apparatus for playing a game of golf for at least two players of claim 17 wherein said game set of indicators includes at least 24 indicators, at least 13 of which bear only one of the following club identifications: 1, 2, 3, 4, 5, 6, 7, 8, 9, W, SW, 7w, 6w, 5w, 4w, 3w, 2w, D, P.

25. The apparatus for playing a game of golf for at least two players of claim 17 wherein said reserve set of indicators includes at least one reserve indicator, each reserve indicator bearing the term Reserve.

26. The apparatus for playing a game of golf for at least two players of claim 25 wherein each reserve indicator bears one of the following club identifications: 1, 2, 3, 4, 5, 6, 7, 8, 9, W, SW, 7w, 6w, 5w, 4w, 3w, 2w, D, P.

27. The apparatus for playing a game of golf for at least two players of claim 26 wherein there are four reserve indicators each bearing one of the following club identifications: 4, 5, 6 and D.

28. The apparatus for playing a game of golf for at least two players of claim 17 wherein said shot set of indicators includes at least one shot indicator, each shot indicator bearing the term Shot.

29. The apparatus for playing a game of golf for at least two players of claim 28 wherein each shot indicator bears one of the following club identifications: 1, 2, 3, 4, 5, 6, 7, 8, 9, W, SW, 7w, 6w, 5w, 4w, 3w, 2w, D, P.

30. The apparatus for playing a game of golf for at least two players of claim 29 wherein there are four shot indicators each bearing one of the following club identifications: 5, 6, 7 and P.

31. The apparatus for playing a game of golf for at least two players of claim 17 wherein each indicator is a golf club.

32. The apparatus for playing a game of golf of claim 31 wherein said game set of indicators further includes a reserve set of indicators bearing reserve indications.

33. The apparatus for playing a game of golf of claim 31 wherein said game set of indicators further includes a shot set of indicators bearing shot indications.

34. The apparatus for playing a game of golf of claim 31 wherein said game set of indicators further includes a flag set of indicators bearing flag indications.

35. A method for playing a game of golf for at least two players at a golf course having a plurality of holes, each hole having at least one tee box and a putting green with a cup, each player having a set of golf clubs including a plurality of irons, a plurality of woods and a putter, comprising the steps of:

providing a game set of indicators, each indicator bearing a club identification;

drawing at least one player indicator for each player from said game set of indicators;

drawing at least one common indicator from said game set of indicators to become a common indicator available to all players;

players playing at least one hole of golf, with each player using only those golf clubs identified on the indicators drawn for him and those identified on the common indicators.

36. The method for playing a game of golf of claim 35 wherein said drawing at least one player indicator step includes each player drawing his own player indicator.

37. The method for playing a game of golf of claim 35 wherein said drawing at least one common indicator step includes a game steward drawing the common indicator.

38. The method for playing a game of golf of claim 35 wherein said drawing at least one player indicator step includes each player drawing two indicators prior to teeing off.

* * * * *